United States Patent [19]

Yamamoto et al.

[11] Patent Number: 4,930,302

[45] Date of Patent: Jun. 5, 1990

[54] BOBBIN TRANSPORTING SYSTEM

[75] Inventors: Yoshio Yamamoto, Kyoto; Hiroshi Hiraoka, Takatsuki, both of Japan

[73] Assignee: Murata Kikai Kabushiki Kaisha, Kyoto, Japan

[21] Appl. No.: 304,494

[22] Filed: Jan. 31, 1989

[30] Foreign Application Priority Data

Feb. 1, 1988 [JP] Japan ..... 63-19497

[51] Int. Cl.[5] ..... B65H 67/06; D01H 9/18

[52] U.S. Cl. ..... 57/281; 57/90; 242/35.5 A

[58] Field of Search ..... 57/90, 281; 242/35.5 R, 242/35.5 A

[56] References Cited

U.S. PATENT DOCUMENTS 4,634,066 1/1987 Matsui et al. ..... 242/35.5 A
4,681,231 7/1987 Ueda et al. ..... 242/35.5 A X
4,683,713 8/1987 Matsui et al. ..... 57/281
4,720,967 1/1988 Güttler ..... 57/281
4,736,581 4/1988 Uchida ..... 57/281

FOREIGN PATENT DOCUMENTS 52475 3/1985 Japan ..... 242/35.5 A

*Primary Examiner*—Joseph J. Hail, III
*Attorney, Agent, or Firm*—Spensley Horn Jubas & Lubitz

[57] ABSTRACT

A bobbin transporting system in which a plurality of spinning frames are connected in parallel to each other to one end side of a single transport conveyor while a plurality of winders are connected to the other end side of the transport conveyor and the transport conveyor is connected to the taking-in sides of the winders or the taking-in sides of the spinning frames by an annular circulating path.

14 Claims, 4 Drawing Sheets

BOBBIN TRANSPORTING SYSTEM

FIELD OF THE INVENTION

This invention relates to a bobbin transporting system, and more particularly to a bobbin transporting system which can attain saving of a spacing for transporting paths which interconnect a spinning frame and a winder.

RELATED ART STATEMENT

Commonly, spinning bobbins produced on a spinning frame are transported to a winder while empty bobbins discharged from the winder after yarns have been rewound therefrom are transported to the spinning frame, and the spinning frame and the winder are connected to each other by means of transporting paths for transporting such spinning bobbins and empty bobbins.

Since a spinning frame at a preceding step and a winder at a following step are basically different in processing capacity, a system is employed wherein a plurality of spinning frames are connected to a single winder.

By the way, in recent years, there is a tendency that the mass production of bobbins proceeds and various kinds of spinning bobbins are handled. Accordingly, a plurality of series of spinning winders in each of which a plurality of spinning frames are connected to a single winder are required, which leads to a problem that transporting paths interconnecting the winder and the spinning frames are increased and a spacing for installation of the same is increased. Meanwhile, in a system wherein spinning frames and a winder are connected directly to each other, when there occurs an imbalance in production between the spinning frames and the winder, spinning bobbins or empty bobbins will sometimes be retarded on a transporting path interconnecting the spinning frames and the winder, which leads to a problem that a trouble of choking of bobbins may occur.

OBJECT AND SUMMARY OF THE INVENTION

It is an object of the present invention to provide a bobbin transport system which can attain saving of a spacing for bobbin transporting paths interconnecting a spinning frame area and a winder area and can improve the circulation of spinning bobbins or empty bobbins transported along the transporting path.

The present invention comprises a bobbin transporting system. According to an embodiment of the present invention a plurality of spinning frames are connected in parallel to each other to one end side of a single transport conveyor while a plurality of winders are connected to the other end side of the transport conveyor, a spinning bobbin transporting path for transporting spinning bobbins produced on the spinning frames to the winders is formed on either one of an upper side and a lower side of the conveyor while an empty bobbin transporting path for transporting empty bobbins discharged from the winders to the spinning frames is formed on the other of the upper side and the lower side of the conveyor, and that the spinning bobbin transporting path and spinning bobbin taking in sides of the winders are connected to each other by an annular circulating path while the empty bobbin transporting path and empty bobbin taking-in sides of the spinning frames are connected to each other by another annular circulating path. The upper and lower portions of the transporting conveyor are thus utilized as the transporting paths for transporting bobbins thereon in order to attain saving of a spacing for the transport paths, and surplus bobbins are caused to wait in the circulating paths in order to adjust an imbalance in production between the spinning frames and the winders.

DETAILED DESCRIPTION OF PREFERRED EMBODIMENTS

In the following, an embodiment of the present invention will be described in detail with reference to the accompanying drawings.

Figure 1:
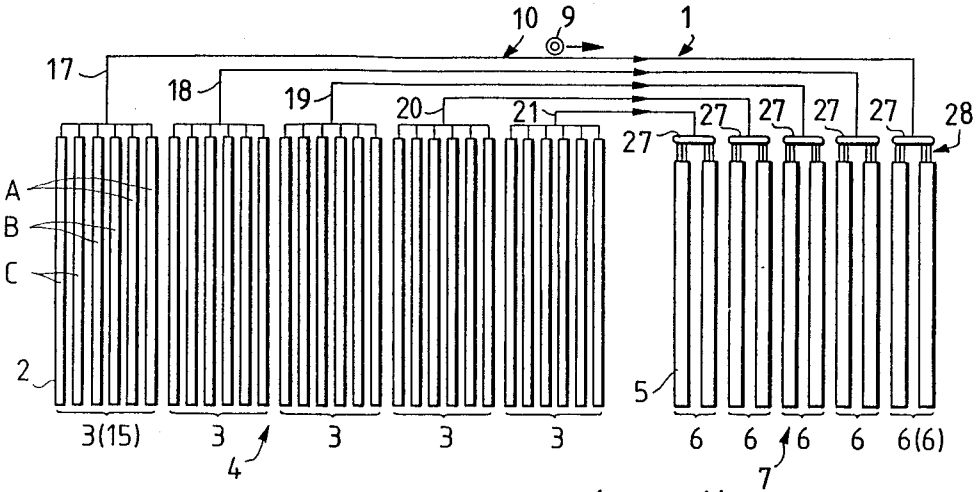
FIGS. 1 and 2 are plan views showing an embodiment of the present invention.
Figure 2:
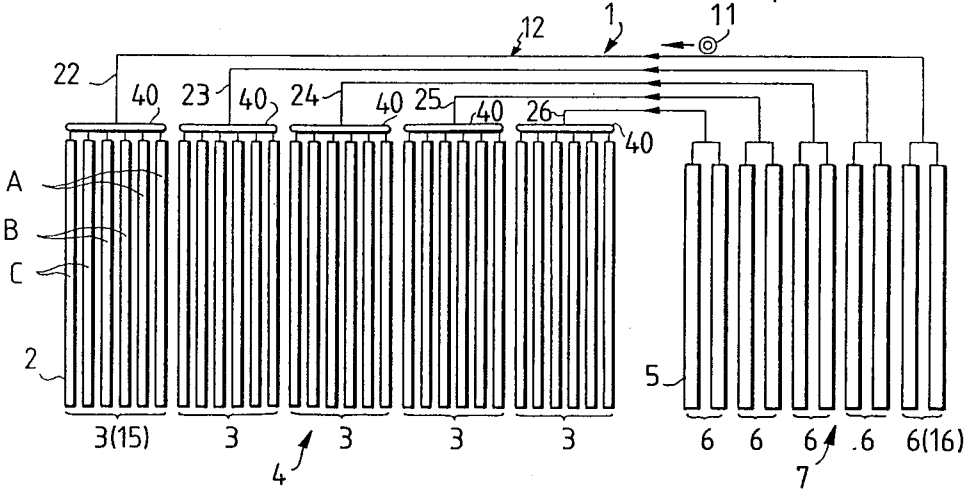

As shown in FIGS. 1 and 2, wide transport conveyors 1 constituted from endless flat belts are installed.

Spinning frames 2 for discharging spinning bobbins therefrom are provided at one ends of the transport conveyors 1. A block 3 is formed from a plurality of such spinning frames 2, and a spinning area 4 is formed from a plurality of such blocks 3.

In the present embodiment, the spinning area 4 is constituted from five blocks 3, and each of the blocks 3 is constituted from six spinning frames 2. Each of the spinning frames 2 is designed to produce several types of spinning bobbins thereon. For example, a system is employed wherein, of the six spinning frames 2, two produce spinning bobbins of a yarn kind A, other two produce spinning bobbins of a yarn kind B, and the remaining two produce spinning bobbins of a yarn kind C.

Meanwhile, winders 5 for accepting therein spinning bobbins produced in the spinning area 4 and for discharging empty bobbins therefrom are provided on the other end sides of the transport conveyors 1. A plurality of such winders 5 form a block 6, and a plurality of such blocks 6 are congregated to form a winder area 7.

In the winder area 7, each of the blocks 6 is formed from two winders 5, and five such blocks 6 are congregated to constitute the winder area 7. Each of the winders 5 handles several types of spinning bobbins, and in the present embodiment, three kinds of spinning bobbins are processed for winding by each of the winders 5.

Figure 3:
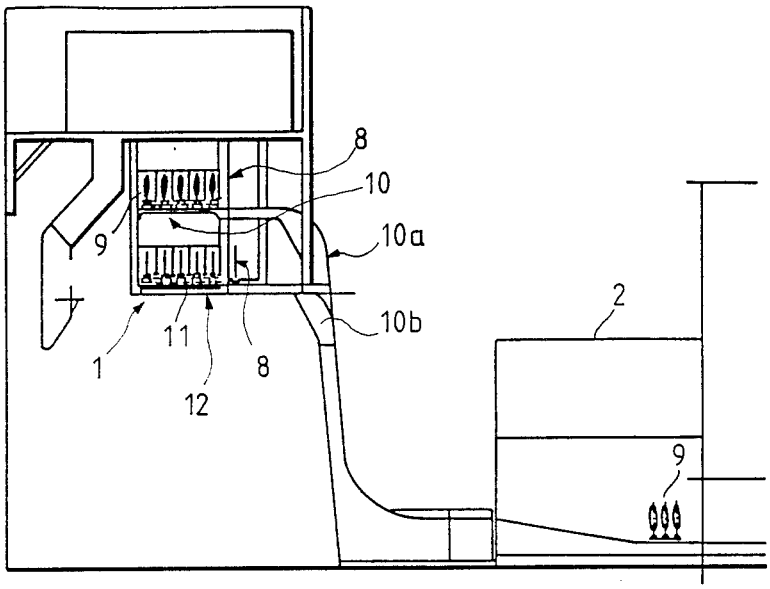
FIG. 3 is a schematic side elevational view, FIG. 4 a plan view showing transporting paths, FIG. 5 a sectional view of a transport conveyor, FIG. 6 a plan view showing taking-in sides of winders, FIG. 7 a front elevational view showing trays, and FIG. 8 a plan view showing taking-in sides of spinning frames.

The spinning area 4 and the winder area 7 are installed on the same floor and also in an offset relationship in a vertical direction to each other as shown in FIG. 3, and the spinning area 4 located below and the winder area 7 located above are interconnected by the transport conveyors 1. Transport paths 8 are formed on the upper sides and the lower sides of the individual transport conveyors 1.

Of the transporting paths 8, the transporting paths 8 formed on the upper sides of the transporting conveyors 1, that is, on the upper sides of outer peripheral portions of the transport conveyors 1, have a plurality of spinning bobbin transporting paths 10 formed thereon for transporting spinning bobbins 9 produced on the spinning frames 2 to the winders 5 through a vertical transporting path 10*a* for transporting spinning bobbins as shown in FIGS. 1 and 3 while the transporting paths 8 on the lower sides of the transport conveyors 1, that is, on the lower sides of inner peripheral portions of the transport conveyors 1, have a plurality of empty bobbin transporting paths 12 formed thereon for transporting empty bobbins 11 discharged from the winders 5 to the spinning frames 2 through a vertical transporting path 10*b* for transporting empty bobbins as shown in FIGS. 2 and 3.

Figure 4:
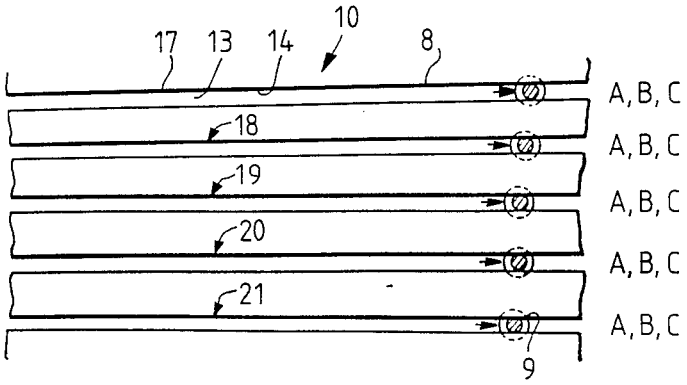

For example, FIG. 4 shows the spinning bobbin transporting paths 10, and the spinning bobbin transporting paths 10 are arranged in a row in a widthwise direction of the transport conveyors 1 and are designed to interconnect the blocks 3 in the spinning area 4 and the blocks 6 in the winder area 7 block by block.

Accordingly, on each of the transporting paths 10, spinning bobbins 9 of the yarn kinds A, B and C produced for the individual blocks 3 in the spinning area 4 exist at random while being transported.

More particularly, each of the transport conveyors 1 is constituted from a belt 13 and guide plates 14 provided above the belt 13, and the plurality of spinning bobbin transporting paths 10 are partitioned and formed by the guide plates 14.

A driving pulley (not shown) is provided at a right end portion of the transport conveyor 1 and a driven pulley (not shown) is provided at the lower side thereof in FIGS. 1 and 2, so that the spinning bobbin transporting path 10 which is formed on the upper side of the wide belt 13 constituting the transport conveyor 1 is located on the tension side of the transport conveyor 1 while the empty bobbin transporting path 12 which is formed at the lower side of the wide belt 13 is located on the slack side of the transport conveyor 1. Accordingly, the belt 3 which carries a number of spinning bobbins thereon can smoothly and stably be moved.

In FIGS. 1 and 4, the block 15 located on the outermost side in the spinning area 4 and the block 16 located on the outermost side in the winder area 7 are interconnected by way of a spinning bobbin transporting path 17 located on the outermost side, and the blocks 3 and 6 located successively on the inner sides are connected to each other by spinning bobbin transporting paths 18, 19, 20 and 21 located successively on the inner sides.

Figure 5:
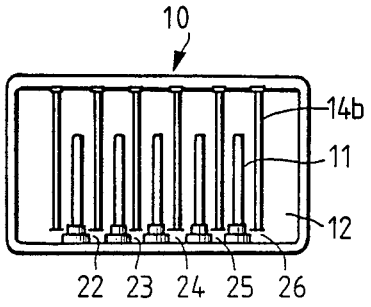

Meanwhile, the empty bobbin transporting paths 12 are constituted from guide plates 14*b* provided in vertical directions in the transport conveyors 1 as shown in FIG. 5, and the plurality of empty bobbin transporting paths 12 interconnecting the blocks 3 in the spinning area 4 and the blocks 6 in the winder area 7 are partitioned and formed by the guide plates 14*b*. In the empty bobbin transporting paths 12, as shown in FIGS. 2 and 5, the block 15 located on the outermost side in the spinning area 4 and the block 16 located on the outermost side in the winder area 7 are interconnected by an empty bobbin transporting path 22 located on the outermost side, and the blocks 3 and 6 located successively on the inner sides are connected to each other by empty bobbin transporting paths 23, 24, 25 and 26 located successively on the inner sides similarly to the empty bobbin transporting paths 10.

Meanwhile, on the bobbin delivery side of the spinning area 4, spinning bobbins 9 discharged from the six spinning frames 2 of each of the blocks 3 are collected together by a baffle or the like and introduced into one of the spinning bobbin transporting paths 10 corresponding to the block 3. Similarly, also on the delivery side of the winder area 7, empty bobbins 11 collected together for each of the blocks 6 are guided into one of the empty bobbin transporting paths 12 corresponding to the block 6.

Figure 6:
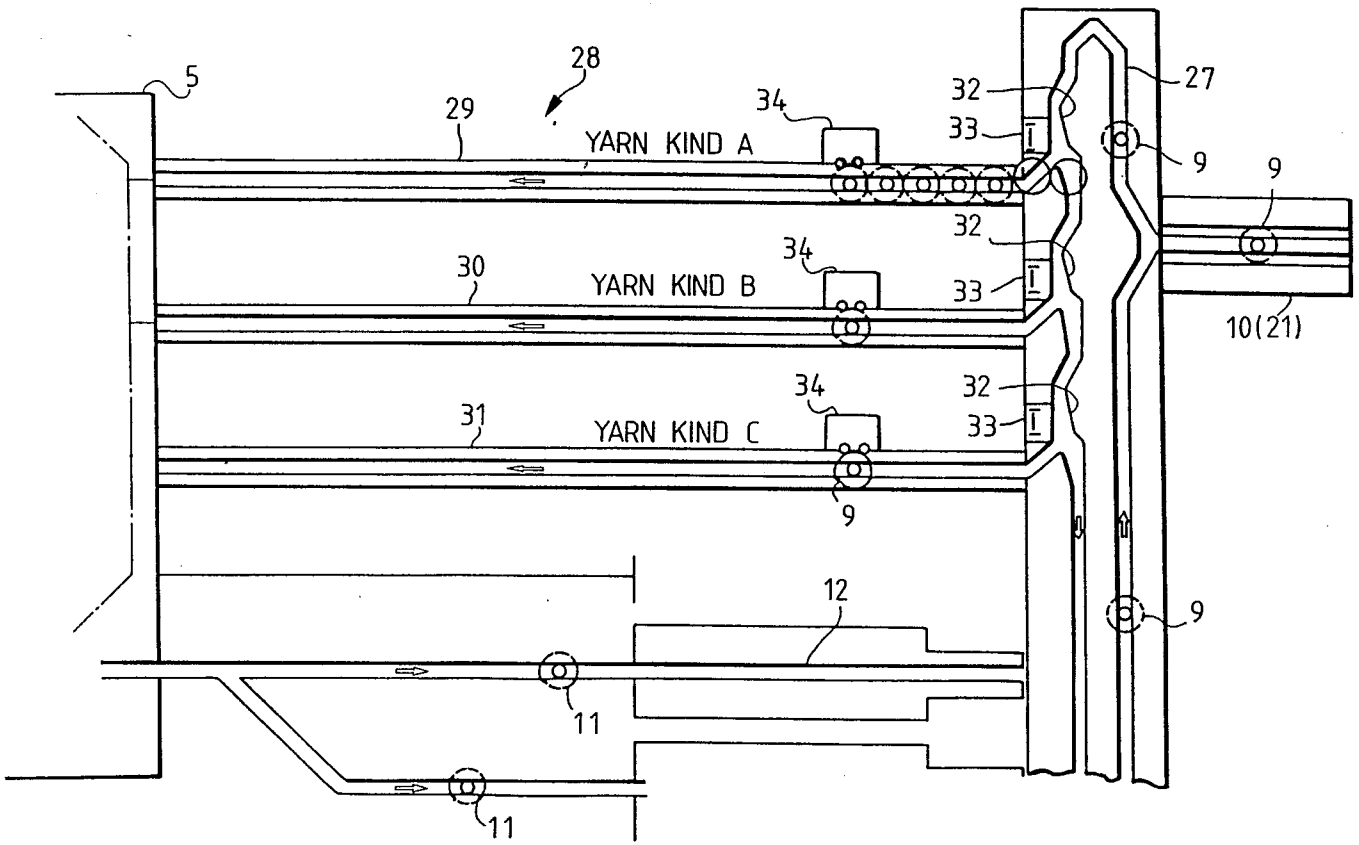

In the meantime, on the bobbin taking-in side of each of the blocks 6 in the winder area 7, an annular circulating path 27 is provided as shown in FIGS. 1 and 6, and the circulating path 27 is connected to the spinning bobbin transporting paths 10 and is connected to each of the winders 5 by way of spinning bobbin taking-in paths 28 as shown in FIG. 6.

In the present embodiment, the spinning bobbin taking-in paths 28 are constituted, for example, from a bobbin path 29 for the bobbin of yarn kind A, another bobbin path 30 for the bobbin of yarn kind B and a further bobbin path 31 for the bobbin of yarn kind C in order to take in spinning bobbins of the individual yarn kinds.

A bobbin discriminating device 33 is provided at each of branch portions 32 between the bobbin taking-in paths 28 and each of the circulating paths 27 while tray stoppers 34 for opening and closing the spinning bobbin taking in paths 28 in response to a request from a winder 5 are provided for pivotal motion adjacent the spinning bobbin taking-in paths 28.

Figure 7:
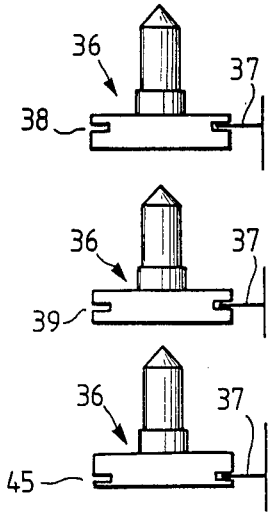

More particularly, each of the discriminating devices 33 is designed to discriminate three kinds of bobbins from trays 36 on which occupied trays 9 and empty trays 11 are to be fitted uprightly as shown in FIG. 7, and an identifying member 37 for discriminating a tray is provided on each of the discriminating devices 33. The identifying member 37 is designed to engage with an identifying groove 38, 39 or 45 formed in each of the trays 36. In particular, the identifying grooves 38, 39 and 45 are set such that they may be different in height depending upon kinds of bobbins.

Figure 8:
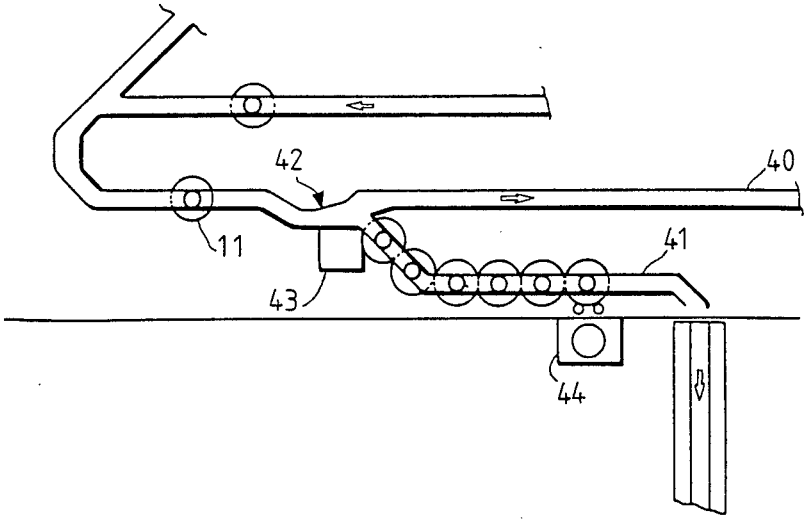

Further, on the empty bobbin taking-in side of each of the blocks 3 in the spinning area 4, the empty bobbin transporting paths 12 and the individual spinning frames 2 are interconnected by an annular circulating path 40 as shown in FIGS. 1 and 8, and an empty bobbin taking-in path 41 is branched from and connected to the circulating path 40 for each of the spinning frames 2. At each of such branch portions 42, a bobbin discriminating device 43 for discriminating a kind of an empty bobbin 11 and distributing it is provided.

Further, tray stoppers 44 for opening and closing the empty bobbin taking-in paths 41 are provided adjacent the empty bobbin taking-in paths 41.

In the following, operation of the present invention will be described.

As shown in FIG. 1, spinning bobbins 9 produced on the spinning frames 2 are fitted uprightly onto trays 36 and discharged for each of the blocks 3 of the spinning area 2, and the thus discharged spinning bobbins 9 are fed to the corresponding individual blocks 6 in the winder area 7 by way of the spinning bobbin transporting paths 10.

Thereupon, in the spinning bobbin transporting paths 10, the spinning bobbins 9 of the yarn kinds A, B and C exist at random while being transported along the individual transporting paths 17, 18, 19, 20 and 21. The spinning bobbins 9 fed along the spinning bobbin transporting paths 10 come to a circulating path 27 on the taking-in side of each of the blocks 6 in the winder area 7 and will be taken into the individual winders 5 from the circulating path 27.

The spinning bobbins 9 transported by the circulating path 27 are discriminated by the bobbin discriminating devices 33 as shown in FIG. 6, and the path 29 for the yarn kind A, the path 30 for the yarn kind B and the path 31 for the yarn kind C are taken into the individual winders 5.

Particularly, when there occurs an imbalance in production efficiency between the spinning frames 2 and the winders 5 so that a large number of spinning bobbins 9 are temporarily flowed into a circulating path 27 and the processing capacities of the winders 5 cannot cope with this, the spinning bobbins 9 will be filled up in the spinning bobbin taking in paths 28. Consequently, the surplus spinning bobbins 9 will wait while being circulated along the circulating path 27. In other words, when there occurs an imbalance in production efficiency ratio between the spinning frames 2 and the winders 5, the rate at which the spinning bobbins 9 are taken in is adjusted by the circulating path 27.

In the meantime, as shown in FIG. 2, empty bobbins delivered from the winders 5 are transported by lower portions of the transport conveyors 1, that is, the empty bobbin transporting paths 12 and come from the blocks 6 of the winders 5 to the individual blocks 3 of the spinning frames 2 corresponding to the blocks 6 similarly to the spinning bobbins 9. Also in this instance, the empty bobbins 11 of the yarn kinds A, B and C existing at random are transported by the individual paths 22, 23, 24, 25 and 26 and individually introduced into the circulating paths 40. When the empty bobbins 11 arrive at the circulating paths 40, the empty bobbins 11 will be discriminated for the individual yarn kinds A, B and C in the circulating paths 40 as shown in FIG. 8 and taken into the spinning frames 2. In particular, the empty bobbins 11 of the type A are taken into the two spinning frames 2, those of the yarn kind B are taken into the other two spinning frames 2 and those of the yarn kind C are taken into the remaining two spinning frames 2.

Meanwhile, in case empty bobbins 11 are excessively taken into a circulating path 40, the surplus empty bobbins 11 will be circulated along and wait in the circulating path 40.

In this manner, since the present invention forms, making use of the upper and lower portions of the transport conveyors 1 and taking notice of the fact that the belts 13 of the upper and lower faces of the same move in the opposite directions to each other, the bobbin transporting paths 10 and 12 on the upper and lower portions of the wide transport conveyors 1 for interconnecting the spinning frames 2 and the winders 5, the area to be occupied by the bobbin transporting paths is decreased, and saving of a spacing can be attained. Further, since the circulating paths 27 and 40 are provided on the taking-in sides of the spinning frames 2 and the winders 5, the imbalance in production efficiency between the spinning frames 2 and the winders 5 can be adjusted by the circulating paths 27 and 40. Accordingly, a retard of bobbins 9 and 11 is eliminated and a trouble such as choking is eliminated, and a smooth circulation of the bobbins 9 and 11 can be assured.

It is to be noted that while in the embodiment described above the spinning bobbin transporting paths 10 and formed on the upper portions of the transport conveyors 1 and the empty bobbin transporting paths 12 are formed on the lower portions of the transport conveyors 1, it is possible to reverse them to each other.

Further, while in the present embodiment three kinds of bobbins are handled and accordingly the three taking-in paths 29, 30 and 31 are connected to each of the circulating paths 27 of the winder area 7, where bobbins to be handled are of one kind, only one spinning bobbin taking-in path 28 is provided.

In summary, according to embodiments of the present invention, such excellent effects as described below are exhibited.

Since bobbin transporting paths for interconnecting spinning frames and winders are formed at upper and lower portions of transport conveyors, the area occupied by the bobbin transporting paths can be reduced, and saving of a spacing can be attained.

Since circulating paths are provided on the taking-in sides of spinning frames and winders, processing of surplus bobbins is easy, and the circulation of bobbins can be improved.

What Is Claimed Is:

1. A bobbin transporting system, characterized in that a plurality of spinning frames are connected in parallel to each other to one end side of a single transport conveyor while a plurality of winders are connected to the other end side of said transport conveyor, that a spinning bobbin transporting path for transporting spinning bobbins produced on said spinning frames to said winders is formed on either one of an upper side and a lower side of said conveyor while an empty bobbin transporting path for transporting empty bobbins discharged from said winders to said spinning frames is formed on the other of the upper side and the lower side of said conveyor, and that said spinning bobbin transporting path and spinning bobbin taking-in sides of said winders are connected to each other by a first annular circulating path while said empty bobbin transporting path and empty bobbin taking-in sides of said spinning frames are connected to each other by a second annular circulating path.

2. The bobbin transporting system as claimed in claim 1, wherein said spinning frames and said winders are divided and formed of a plurality of blocks of the spinning frames or winders, said each of the blocks being so constituted to process several types of bobbins, and one block at the spinning frame side and one block at the winder side are connected by a spinning bobbin transporting path and an empty bobbin transporting path.

3. The bobbin transporting system as claimed in claim 2, wherein the single transport conveyor includes a plurality of spinning bobbin transporting paths and a plurality of empty bobbin transporting paths which comprise a belt and guide plates provided above the belt to partition the belt.

4. The bobbin transporting system as claimed in claim 3, wherein the first annular circulating path is provided at a spinning bobbin taking-in side of a block of the winders and the second annular circulating path is provided at an empty bobbin taking-in side of a block of the spinning frames.

5. The bobbin transporting system as claimed in claim 4, wherein the first annular circulating path is connected with each of winders by means of spinning bobbin taking-in paths and a bobbin discriminating device is provided at each of branch portions between the spinning bobbin taking-in paths and the first annular circulating paths.

6. The bobbin transporting system as claimed in claim 4, wherein the second annular circulating path is connected with each of spinning frames by means of empty bobbin taking-in paths and a bobbin discriminating device is provided at each of branch portions between the empty bobbin taking-in paths and the second annular circulating paths.

7. The bobbin transporting system as claimed in claim 5 or 6, wherein each of the spinning bobbins and the empty bobbins is fitted on a tray to be transported thereby and said bobbin discriminating device comprises an identifying member which is designed to engage with an identifying groove formed in each of the trays.

8. A bobbin transporting system for transporting spinning bobbins from a plurality of spinning frames to a plurality of winders and for transporting empty bobbins from the plurality of winders to the plurality of spinning frames, the system comprising:

an empty bobbin transporting path arranged to receive empty bobbins from the plurality of winders;

a spinning bobbin transporting path arranged to receive spinning bobbins from the plurality of spinning frames;

a spinning bobbin circulating path defining a closed loop path arranged to receive spinning bobbins from the spinning bobbin transporting path, the spinning bobbin circulating path being connected with the plurality of winders to convey spinning bobbins received from the spinning bobbin transporting path to the plurality of winders; and an empty bobbin circulating path defining a closed loop path arranged to receive empty bobbins from the empty bobbin transporting path, the empty bobbin circulating path being connected with the plurality of spinning frames to convey empty bobbins received from the empty bobbin transporting path to the plurality of spinning frames.

9. A bobbin transporting system for transporting spinning bobbins from a plurality of spinning frames to a plurality of winders and for transporting empty bobbins from the plurality of winders to the plurality of spinning frames, the system comprising:

a transport conveyor having a plurality of empty bobbin transporting paths arranged to receive empty bobbins from the plurality of winders, and a plurality of spinning bobbin transporting paths arranged to receive spinning bobbins from the plurality of spinning frames;

a plurality of empty bobbin circulating paths, each empty bobbin circulating path being connected with, and operable to receive empty bobbins from, one of the empty bobbin transporting paths, each empty bobbin circulating path also being connected with at least two of the spinning frames; and a plurality of spinning bobbin circulating paths, each spinning bobbin circulating path being connected with, and operable to receive spinning bobbins from, one of the spinning bobbin transporting paths, each spinning bobbin circulating path also being connected with at least two of the winders.

10. A bobbin transporting system as claimed in claim 9, wherein each of the empty bobbin circulating paths and each of the spinning bobbin circulating paths define a closed loop path.

11. A bobbin transporting system as claimed in claim 9, wherein:

the at least two spinning frames connected with each empty bobbin circulating path are operable to process at least two different types of empty bobbins;

the at least two winders connected with each empty bobbin circulating path are operable to process at least two different types of spinning bobbins corresponding to the two different types of empty bobbins;

each empty bobbin transporting path comprises means for transporting the two different types of empty bobbins in random order, with respect to the two different types; and each spinning bobbin transporting path comprises means for transporting the two different types of spinning bobbins in random order, with respect to the two different types.

12. A bobbin transporting system as claimed in claim 11, further comprising spinning bobbin discriminating means, arranged between each spinning bobbin circulating path and each winder connected thereto, for discriminating between types of spinning bobbins.

13. A bobbin transporting system as claimed in claim 12, further comprising empty bobbin discriminating means, arranged between each empty bobbin circulating path and each spinning frame connected thereto, for discriminating between types of empty bobbins.

14. A bobbin transporting system as claimed in claim 11, further comprising empty bobbin discriminating means, arranged between each empty bobbin circulating path and each spinning frame connected thereto, for discriminating between types of empty bobbins.

* * * * *